US007094036B2

(12) United States Patent
Mennie et al.

(10) Patent No.: US 7,094,036 B2
(45) Date of Patent: Aug. 22, 2006

(54) VACUUM PUMPING SYSTEM

(75) Inventors: Darren Mennie, Portishead (GB); Ron Clark Lee, Bloomsbury, NJ (US); Robert Bruce Grant, Steyning (GB); Barrie Dudley Brewster, Brighton (GB); Joanne Rachel Greenwood, Hove (GB)

(73) Assignee: The BOC Group plc, Windlesham (GB)

( * ) Notice: Subject to any disclaimer, the term of this patent is extended or adjusted under 35 U.S.C. 154(b) by 79 days.

(21) Appl. No.: 10/669,775

(22) Filed: Sep. 24, 2003

(65) Prior Publication Data

US 2005/0063830 A1 Mar. 24, 2005

(51) Int. Cl.
*F04B 43/12* (2006.01)
*F04B 23/08* (2006.01)

(52) U.S. Cl. ..... 417/53; 417/205; 417/313

(58) Field of Classification Search ..... 417/53, 417/62, 205, 245, 313, 423.4, 423.5
See application file for complete search history.

(56) References Cited

U.S. PATENT DOCUMENTS 4,750,925 A * 6/1988 MacLean et al. ..... 62/624
4,995,794 A * 2/1991 Wycliffe ..... 417/431
5,236,562 A * 8/1993 Okumura et al. ..... 204/155
5,430,752 A * 7/1995 Basting et al. ..... 372/59
5,707,213 A 1/1998 Conrad
5,836,746 A * 11/1998 Maruyama et al. ..... 417/44.1
6,644,931 B1 * 11/2003 Puech ..... 417/205
6,815,700 B1 * 11/2004 Melnychuk et al. .... 250/504 R

FOREIGN PATENT DOCUMENTS

JP 10-259793 9/1998
JP 2000-81857 3/2002

OTHER PUBLICATIONS

T. Mitsushina, F. Shinji, M. Hidetoshi; Abstract of JP 2000-81857 A, dated Mar. 22, 2002 entitled Rear Gas Recovering Method and Device Therefor; WPI/Derwent.
I. Masashi, S. Mitsuru, O. Masatomo; Abstract of JP 10-259793, dated Sep. 29, 1998 entitled Molecular Pump; WPI/Derwent.
United Kingdom Patent Office Search Report Application No. GB0407081.9; Date of search: Aug. 5, 2004.

* cited by examiner

*Primary Examiner*—Charles G. Freay
(74) *Attorney, Agent, or Firm*—Ira Lee Zebrak

(57) ABSTRACT

A vacuum pumping system comprises a first gas supply for supplying a first gas, such as xenon, to a vacuum chamber. A pump receives the gas output from the chamber. A second gas supply supplies a purge gas, such as nitrogen or helium, for pumping with the first gas. A gas separator receives the pumped gases exhausted by the pump, and recovers the first gas and the purge gas from the stream. The recovered first gas is recirculated through the vacuum chamber, and the recovered second gas is recirculated through at least the pump.

45 Claims, 3 Drawing Sheets

VACUUM PUMPING SYSTEM

BACKGROUND OF THE INVENTION

The present invention relates to a vacuum pumping system suitable for pumping low thermal conductivity gases, such as argon and xenon.

Extreme Ultra Violet Lithography (EUVL) extends the current technology of optical lithography by using wavelengths in the range 11 to 14 nm, in order to shrink the size of printable features in the manufacture of integrated circuits. At these wavelengths all materials are strongly absorbing, and therefore this type of lithography must be performed under vacuum.

The source for EUV radiation may be based on excitation of tin, lithium, or xenon. The use of metallic materials such as tin and lithium presents the difficulty that these materials may be evaporated and become deposited on sensitive optical components. Where xenon is used, light is generated in a xenon plasma either by stimulating it by an electric discharge or by intense laser illumination. Because the EUV radiation has very poor transmissibility through xenon, it is necessary to reduce the pressure in the area around the plasma using a vacuum pumping system. However, pumping the quantities of xenon required (up to 10 slpm at $1\times10^{-2}$ mbar) for the production of the plasma with conventional turbo-molecular pumps is not possible.

From first principles, work is done when a gas is compressed, or expanded. The process can be considered adiabatic in a well-insulated system or where the process is so rapid that there is not enough time for appreciable heat transfer to take place. As a gas is compressed, its temperature increases as work is being done to it, increasing its internal energy. For expansion, the adiabatic process is reversed and the temperature decreases.

For an ideal gas the specific heat capacity at constant pressure is given by Cp=Cv+R, where Cv is the molar specific heat capacity at constant volume, and R the specific gas constant. The ratio of specific heats (or the molar heat capacity) of a monatomic gas is given by.$\gamma$=Cp/Cv=(5R/2)/(3R/2)=5/3.

A mechanical vacuum pump and the gas being pumped can be considered as a closed thermodynamic system. The pump takes a body of gas and compresses it, allows it to expand, and exhausts it to atmosphere. In the simplistic case of assuming adiabatic compression, the volumetric ratio of inlet to outlet is given by $$\frac{V_1}{V_2} = \left(\frac{p_2}{p_1}\right)^{1/\gamma} \tag{1}$$

The outlet temperature $T_2$ is given by $$T_2 = T_1\left(\frac{V_1}{V_2}\right)^{\gamma-1} \text{ or} \tag{2}$$

$$T_2 = T_1\left(\frac{p_2}{p_1}\right)^{\gamma-1/\gamma} \tag{3}$$

Xenon is monatomic and has a high molar heat capacity ($\gamma$=1.667) combined with low thermal conductivity (making it a good insulator). The molar heat capacity and the thermal conductivity of a gas are related to its molecular structure. The atomic mass (131.29 amu) and radius (108 pm) of xenon is greater than that of argon (39.95 amu and 98 pm, respectively). Some properties of xenon, argon, helium and nitrogen are given in Table 1 below for comparison.

TABLE 1

| | Xe | Ar | He | $N_2$ |
|---|---|---|---|---|
| Atomic number | 54 | 18 | 2 | 7 |
| Atomic mass, amu | 131.29 | 39.948 | 4.003 | 14.01 |
| Atomic radius, pm | 131 | 88 | 49 | 75 |
| Gas density, (liquid density), kg/m$^3$ | 5.54, (3057) | 1.784, (1394) | 0.1785, (122) | 1.251, (806.5) |
| Ratio of molar heat capacities, ($\gamma$) | 1.667 | 1.667 | 1.667 | 1.4 |
| $T_{crit}$, ° C. @ atm | 16.6, (8° C. @ 50 bar) | (−122° C. @ 50 bar) | −267.96 | (−146.9° C. @ 50 bar) |
| $T_{boil}$, ° C. | −108 | −186 | −268.785 | −195.8 |
| $T_{melt}$, ° C. | −111.7 | −189.3 | −272.05 | −210.1 |
| Thermal conductivity, W/mK | 0.00565 | 0.01772 | 0.14 | 0.02583 |

From equation (3) above, even for a moderate vacuum (0.1 mbar), the outlet temperature of the gas would be considerable. Ordinarily, for diatomic gases or those with higher thermal conductivities and smaller atomic masses, the fact that the gas expands before being exhausted from the pump would result in a considerable temperature reduction. However, xenon is averse to relinquishing its newly acquired heat energy.

The difficulty in pumping xenon with a turbo-molecular pump occurs primarily at the inlet of the pump. The first stage comprises an axial compressor made up of rotating blades separated by stationary blades. They operate under molecular flow conditions and the incident of the rotor blades is designed to encourage the molecules axially through the stages down to the exhaust or high-pressure end of the pump. The rapidly rotating blades of the turbo-molecular pump hit the molecules of gas in the chamber. This collision transfers some momentum to the particles. This process of momentum transfer is more efficient if the average linear velocity of the molecule is less than the linear velocity of the blade tip. For a xenon molecule, the average velocity at 27° C. is 318 m/s. However, the larger the mean blade diameter of the pump, the higher the tip speed. Generally small turbo-molecular pumps (<500l/s $N_2$) are designed to run at very high speeds (>50,000 rpm) and the larger pumps (>1000l/s $N_2$) run at slower speeds (<30,000 rpm) in order to pump the light gases, as the efficiencies of turbo-molecular pumps are greatest for the heavier gases. Xenon molecules are "heavy" by comparison to lighter gases and therefore move more slowly through the pump. As work is being done on the heavy xenon molecules, their internal energy is increased and heat is produced. As the metal impeller has a high thermal conductivity, this heat is conducted through the impeller rapidly whilst the static component remains cold. For effective molecular pumping, the clearances between the rotor and stator must be of the order of microns. In some cases, the thermal expansion of the rotor, differentially from the stator, causes failure.

Some pumps are also designed with a "self-cooling" back leakage from the exhaust over the stator and rotor seating. This works to the detriment of the pump in the case of xenon, as the already hot gas now re-circulates in the back of the pump, which gets progressively hotter. This is further aggravated by the insulating nature of the gas, which holds onto the heat energy.

Typically, improvement of the pumping process is carried out by the use of a purge gas lighter than xenon in the turbo-molecular pump. On average lighter gas molecules, like $N_2$ and He, travel faster than heavier gases (e.g. Xe). Therefore, these gases have a higher impingement rate on the walls of a chamber or on the blades of the turbo-molecular pump, but they also have smaller momentum. The average speed ($\overline{v}$) of a gas molecule is dependant upon the mass (M) of the molecule and temperature (T), as set out below.

$$\overline{v} = \sqrt{\frac{8 R_0 T}{\pi M}} \ (m/s) \tag{4}$$

For example, at room temperature the average speed of molecules of He, $N_2$, and Xe, are 1245 m/s, 470 m/s, and 215 m/s, respectively. The higher the temperature, the greater the average speed, and the average speed will be greatest for the gas whose molecules have the least mass. As He (k=0.14 W/mK) has a considerably greater thermal conductivity than Xe (0.00565 W/mK), the He molecules would aid the transfer of heat from the pump and the Xe gas. This can maintain the temperatures inside the pump at levels that allow reliable pump operation for much longer periods than would be possible in the absence of a light purge gas.

As xenon occurs in atmospheric air in very low concentrations (around 0.087 ppm), the cost is very high. It is therefore very desirable to recover and re-use the xenon. One method available for the recovery of xenon is the use of a low temperature (cryogenic) trap to freeze the xenon while permitting the noncondensable light purge gas to pass through the trap and be vented to atmosphere. Once the trap has captured a sufficient amount of xenon, it can be regenerated by heating, which vaporizes the xenon so that it can be collected separately.

However, the presence of the purge gas in the pumped xenon stream makes the purification and subsequent recycle of the xenon particularly complex and costly. For example, suppose that the flow rate of the xenon being pumped out of the chamber is 0.4 slpm. Suppose also that a light purge gas, say $N_2$, is added to the turbo-molecular pump at a flow rate of 3.6 slpm. The pump output is now 4.0 slpm at $10^{-3}$ bar with 90% $N_2$ and 10% Xe therein ($p_{Xe}=10^{-4}$ bar). If the cryogenic trap to which this gas mixture is fed is operated using liquid nitrogen at or slightly above ambient pressure as the refrigerant, the operating temperature of the trap could be as low as −192° C. The vapour pressure of xenon at this temperature is about $10^{-5}$ bar. Thus, the noncondensable $N_2$ gas leaving the trap at $10^{-3}$ bar takes with it xenon at $10^{-5}$ bar (Xe content is thus 1%). This outlet stream thus has a flow rate of 3.6364 slpm, with 99% $N_2$ (molar flow is still 3.6 sipm) and 1% Xe. Note that the molar flow rate of xenon in this stream is about 0.0364 slpm, which represents more than 9% of the xenon extracted from the vacuum chamber (0.4 slpm). This loss of xenon would be much higher if the trap could not be operated at such a low temperature. If this 9% or higher loss of xenon on a continuous basis is acceptable, a simple cryogenic trap operated in a conventional scheme is sufficient for xenon recycle, with the light purge gas with the uncaptured xenon in it being rejected as waste from the system. However, in the application of xenon to EUV lithography, the economics do not allow for such a high wastage of xenon.

It is an aim of the present invention to provide a more cost-effective apparatus for, or a method of, pumping low thermal conductivity gases, such as argon and xenon.

SUMMARY OF THE INVENTION

In a first aspect, the present invention provides a vacuum pumping system comprising a pump having an inlet for receiving from a vacuum chamber at least a first gas to be pumped; means for supplying a second, purge gas to be pumped with the first gas; the pump having an outlet for exhausting a gas stream comprising the first gas and the purge gas; and gas separating means for receiving the gas stream and recovering the purge gas from the stream, the supply means being arranged to receive from the gas separating means the recovered purge gas.

By not wasting the purge gas by exhaust to atmosphere, but rather recirculating the purge gas for re-use, any first gas remaining in the purge gas output from the separating means is not lost, but is retained in the system. Furthermore, as the purge gas is not wasted, species such as helium, having relatively high expense but superior heat-transfer characteristics in respect of other gases, such as nitrogen, can be employed as the purge gas.

In one arrangement, the supply means is arranged to supply the purge gas directly to the pump. In an alternative arrangement, the supply means is arranged to supply the purge gas to the vacuum chamber.

If, for example, a turbo-molecular pump is employed as the first pump, pumped gases are typically exhausted from such a pump at a pressure of around $10^{-3}$ bar. If the pump is capable of handling purge gas returned at such a pressure, then the pressurised gas stream output from the pump can be supplied to the separator, and the still-pressurised, recovered purge gas returned to the pump. If not, then a backing pump will be required to raise the pressure of the purge gas, for example to slightly above ambient for return to the pump. Thus, in one arrangement, the system comprises a second pump having an inlet for receiving the gas stream from the first-mentioned pump and an outlet for exhausting the gas stream to the gas separating means, and in an alternative arrangement, the system comprises a second pump having an inlet for receiving the recovered purge gas from the gas separating means and an outlet for exhausting the purge gas to the conveying means. The former can provide for improved separation of the first gas, such as xenon, from the exhausted gas stream in order to reduce the amount of xenon within the purge gas output from the separator and returned to the pump.

If it is found that the backing pump introduces any heavy impurities into the purge gas, a purifier, such as an ambient-temperature cartridge-type gas purifier, which will not affect the first and purge gases, can be employed.

Preferably, the system comprises means for recirculating the first gas from the separating means to the vacuum chamber. Preferably, the recirculating means comprises means for pressurising and/or purifying the first gas prior to its return to the chamber. This can enable expensive gases, such as xenon, to be recycled and returned to the vacuum chamber for re-use, thereby providing significant cost savings.

The conveying means may include means for controlling the rate of supply of the purge gas to the pump. For example, the control means may be arranged to adjust the supply rate according to the composition of the purge gas returning to the pump, for example, according to the amount of first gas within the purge gas, and/or according to the speed of the pump. Dynamic adjustment of the rate of supply of the purge gas to the pump can ensure that there is no undesirable heating of the pump components during pumping.

The separating means preferably comprises cryogenic separating means, such as one or more cryogenic traps, for separating the first gas from the gas stream, for example, by condensing the first gas and not the second gas, to recover the first and second gases. The first pump preferably comprises a turbo-molecular pump, so that a pressure of around $10^{-9}$ bar can be maintained in the vacuum chamber. The first gas may comprise a low thermal conductivity gas, such as xenon or argon. The second gas may be lighter than the first gas, and may comprise one of helium and nitrogen.

Combination in the turbo-molecular pump of such a purge gas with, for example, xenon can reduce heating of the pump during pumping of the xenon. This can enable the system to employ a standard vacuum pump operating within its normal operating envelope, and hence with minimal risk in comparison to a non-standard pump operating at the limits of its normal operating envelope. Cryogenic traps can provide a relatively simple means for effecting a separation between the xenon and the purge gas components of the pumped gases by freezing a large fraction of the received xenon and generating an outlet gas stream primarily consisting of the purge gas but also including xenon at a concentration related to its vapour pressure at the operating temperature of the cryogenic trap. Although the xenon concentration in the gas stream leaving the separator is considerably reduced relative to that in the pumped gases, the cost of replacing the xenon lost from the system would be significant if the purge gas was wasted rather than returned back to the pump for repeated re-use.

In a second aspect, the present invention provides a vacuum pumping system, comprising first gas supply means for supplying a first gas to a vacuum chamber; a pump arranged to receive at least the first gas from the chamber; second gas supply means for supplying a second gas for pumping with the first gas; and gas separating means for receiving a gas stream output from the pump, recovering the first and second gases from the gas stream, outputting the recovered first gas to the first gas supply means for recirculation through at least the chamber and outputting the recovered second gas to the second gas supply means for recirculation through at least the pump.

The present invention extends to an extreme ultra violet lithography apparatus comprising a vacuum pumping system as aforementioned.

In a third aspect, the present invention provides a method of vacuum pumping, comprising receiving at a pump at least a first gas from a vacuum chamber, and a second, purge gas for pumping with the first gas; exhausting from the pump a gas stream comprising the first and second gases; recovering the second gas from the stream and recirculating the second gas through at least the pump.

In a fourth aspect, the present invention provides a method of vacuum pumping comprising receiving at a pump at least a first gas from a vacuum chamber, and a second gas for pumping with the first gas; recovering from a gas stream exhausted from the pump the first and second gases; recirculating the recovered first gas through at least the chamber and recirculating the recovered second gas through at least the pump.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
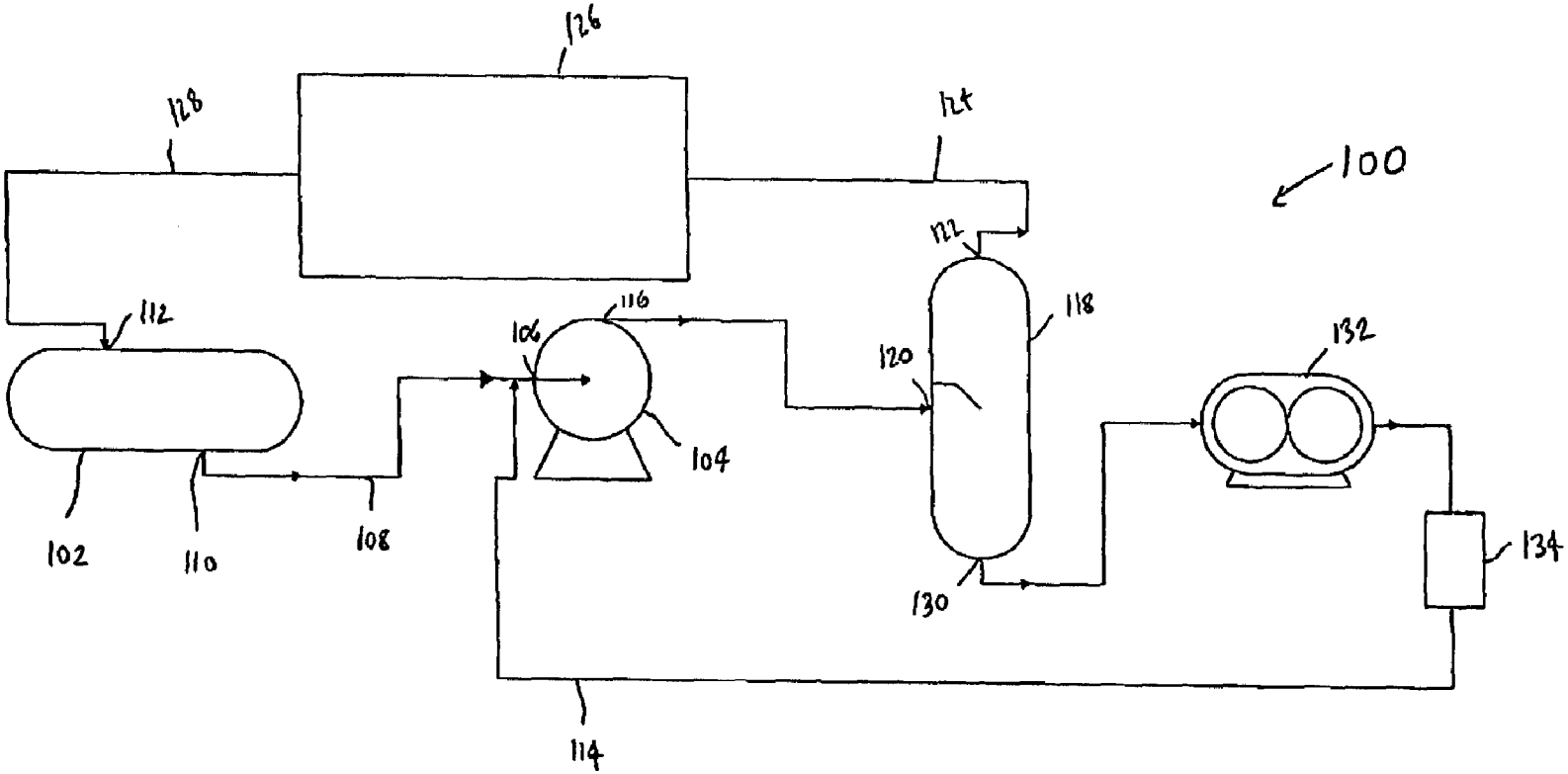
FIG. 1 illustrates schematically a first embodiment of a vacuum pumping system.

With reference to FIG. 1, a system 100 for the vacuum pumping of chamber 102 comprises a turbo-molecular pump 104 for pumping chamber 102. The pump 104 has an inlet 106 connected to conduit 108 for conveying gas from the outlet 110 of the chamber 102 to the pump 104. The chamber 102 may be any one of a number of different types of chamber used to perform various processes in the semiconductor industry. In this example, the chamber 102 is a vacuum chamber in which extreme ultra violet (EUV) radiation is generated for use in extreme ultra violet lithography. For this purpose, the chamber 102 has an inlet 112 for receiving a stream of xenon in gaseous or liquid form, from which EUV radiation is generated in a xenon plasma either by stimulating it by an electrostatic discharge or by intense laser illumination within chamber 102.

To enable a standard turbo-molecular pump 104 to be used to pump xenon from the chamber without pump damage being incurred due to heating thereof by the pumped xenon, a purge gas lighter than xenon, such as helium or nitrogen, is supplied to the pump 104 via conduit 114 for pumping with the xenon. The gas stream exhausted from the pump 104 via outlet 116, typically at a pressure of around $10^{-3}$ bar, thus contains the xenon received from the chamber 102, the purge gas, and contaminants, for example any permanent gases, such as argon, present in chamber 102 and any debris generated during the production of EUV radiation within the chamber.

In view of the high cost of xenon, the xenon output from the chamber 102 is recirculated back to the chamber 102 for re-use. In order to recover the xenon from the gas stream exhausted from the pump 104, the system 100 includes a cryogenic gas separator or trap 118 having an inlet 120 for receiving the gas stream exhausted from the pump 104. The trap 118 is operated using liquid nitrogen at or slightly above ambient pressure as the refrigerant, producing an operating temperature of the trap as low as −192° C. As the xenon entering the trap 118 is typically at a pressure of around $10^{-3}$ bar, the cryogenic temperature within the cryogenic trap 118 causes the xenon contained within the gas stream to freeze, with the light purge gas passing through the trap 118. Once the trap 118 has captured a sufficient amount of xenon, it is regenerated by heating, which vaporizes the xenon. The thus-recovered gaseous xenon is output from a first outlet 122 of the trap 118 and supplied via conduit 124 to a xenon recycle system 126, which purifies and pressurises the xenon before it is returned via conduit 128 to the chamber inlet 112 in gaseous or liquid form.

The trap 118 has a second outlet 130 through which the noncondensing purge gas leaves the trap 118. As the purge gas thus recovered from the gas stream entering the trap 118 is likely to still contain traces (around 1%) of xenon, rather than simply venting the purge gas to atmosphere, the pumping system 100 recirculates the purge gas through the pump 104 for re-use. As shown in FIG. 1, the conduit 114, which supplies the purge gas to the pump 104, is connected to the outlet 130 of the trap 118. As the purge gas leaving the trap 118 will also be at a pressure of around $10^{-3}$ bar, a backing pump 132 may optionally be provided between the trap outlet 130 and the pump 104 to raise the pressure of the purge gas, for example to slightly above ambient for return to the pump 104. A purifier 134 may be provided downstream of the backing pump 134 for purifying the purge gas exhaust from the backing pump 132 prior to its return to the pump 104.

As well as ensuring that any xenon remaining in the purge gas output from the trap 118 is not lost, but is retained in the system 100, the system enables species such as helium, having relatively high expense but superior heat-transfer characteristics in respect of other gases, such as nitrogen, to be employed as the purge gas.

Figure 2:
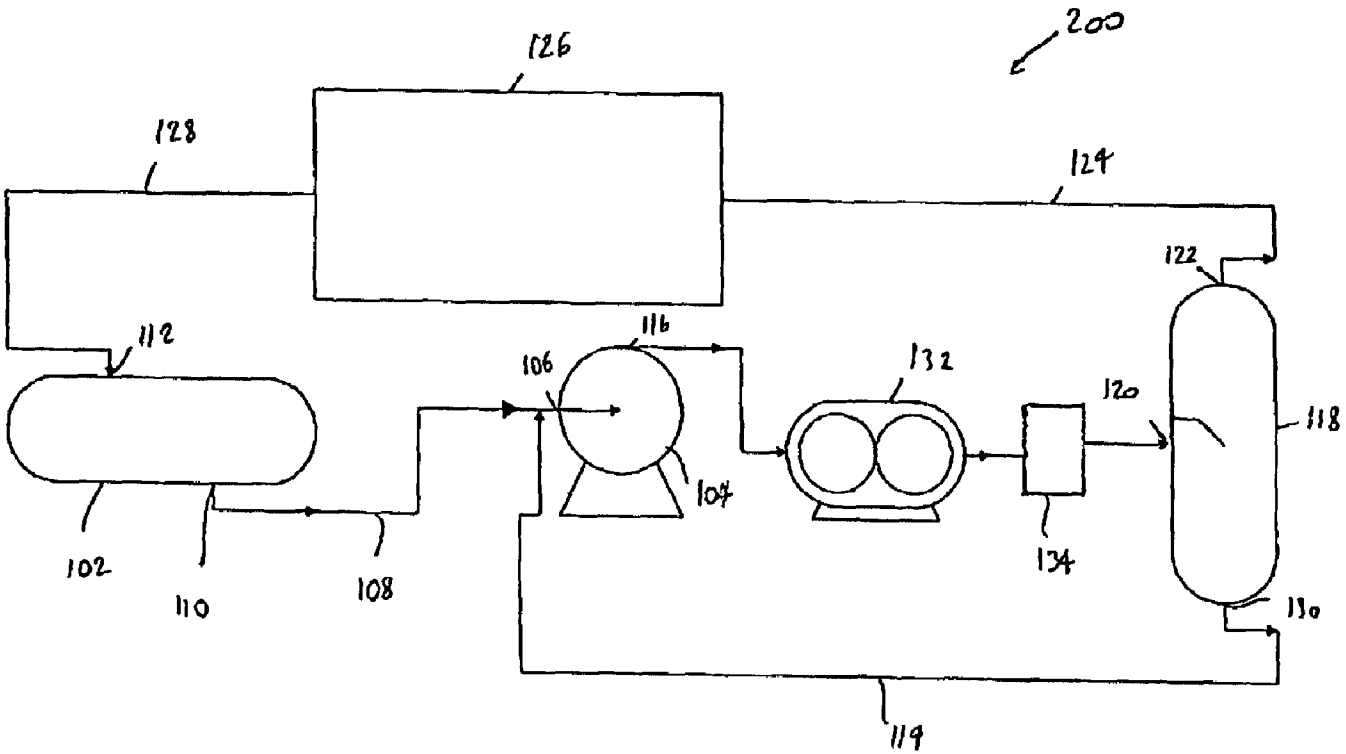
FIG. 2 illustrates schematically a second embodiment of a vacuum pumping system.

FIG. 2 illustrates a second embodiment of a vacuum pumping system 200. The second embodiment is similar to the first embodiment, except that the backing pump 132 and purifier 134 are arranged downstream of the turbo-molecular pump 104 rather than downstream of the trap 118, as in the first embodiment. As a result, the gas stream exhausted from the purifier 134 enters the trap 118 at or slightly above ambient. This can allow for greater extent of recovery of xenon from the gas stream for recirculation to the chamber 102, so that the purge gas recirculated to the pump 104 contains a lower level of xenon.

Figure 3:
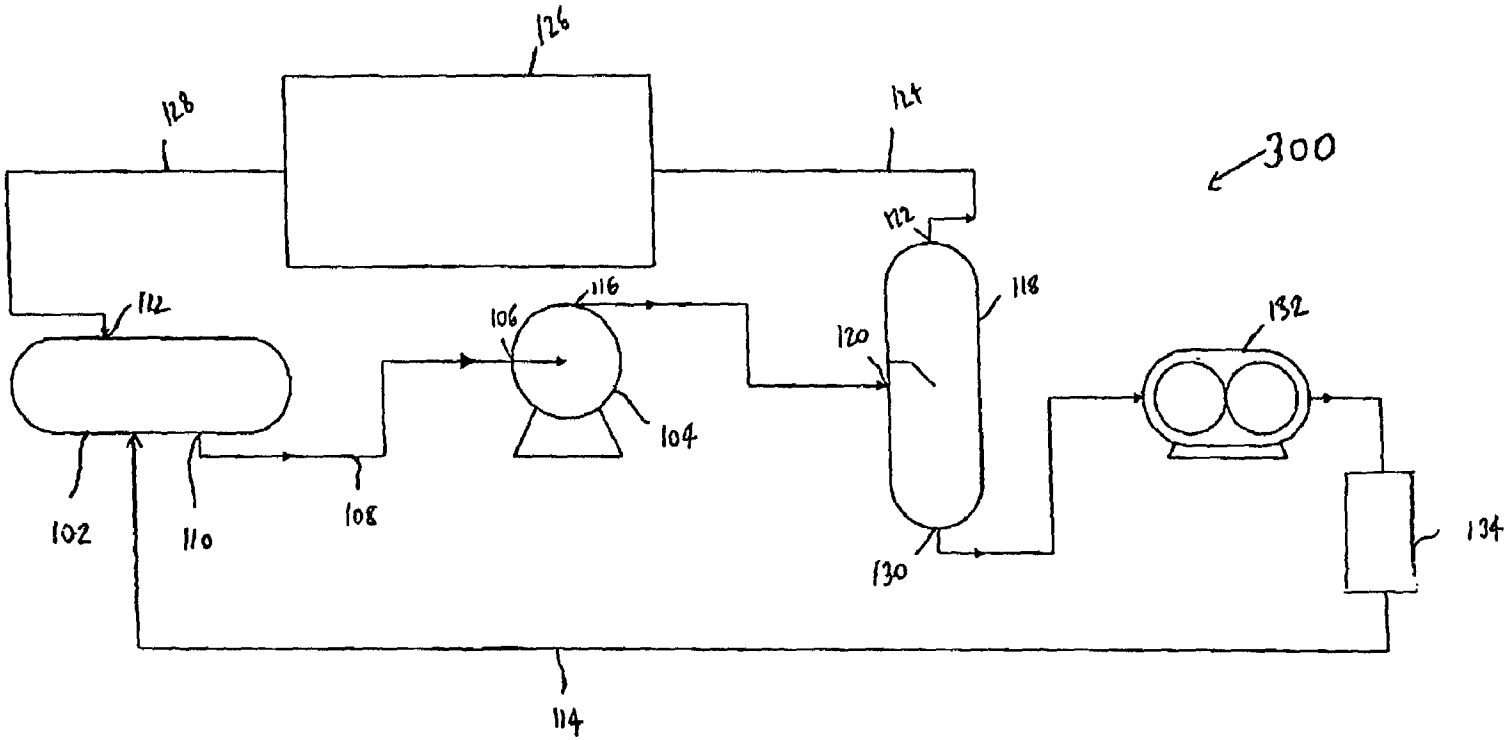
FIG. 3 illustrates schematically a third embodiment of a vacuum pumping system.

FIG. 3 illustrates a third embodiment of a vacuum pumping system 300. The third embodiment is also similar to the first embodiment, except that the conduit 114 supplies the purge gas to the vacuum chamber 102 rather than directly to the pump 104, so that the pump 104 receives from the chamber 102 both the xenon and the purge gas for pumping. As a result, the pumping system 300 recirculates both the xenon and the purge gas through both the vacuum chamber 102 and the pump 104.

In summary, a vacuum pumping system comprises a first gas supply for supplying a first gas, such as xenon, to a vacuum chamber. A pump receives the gas output from the chamber. A second gas supply supplies a purge gas, such as nitrogen or helium, for pumping with the first gas. A gas separator receives the pumped gases exhausted by the pump, and recovers the first gas and the purge gas from the stream. The recovered first gas is recirculated through the vacuum chamber, and the recovered second gas is recirculated through at least the pump.

The invention claimed is:

1. A vacuum pumping system comprising a pump having an inlet for receiving from a vacuum chamber at least a first gas to be pumped; means for supplying a second, purge gas to be pumped with the first gas; the pump having an outlet for exhausting a gas stream comprising the first gas and the purge gas; and gas separating means for receiving the gas stream and recovering the purge gas from the stream, the supply means being arranged to receive from the gas separating means the recovered purge gas.

2. The system as claimed in claim 1, wherein the pump is arranged to receive the recovered purge gas.

3. The system as claimed in claim 1, wherein the supply means is arranged to supply the purge gas to the vacuum chamber.

4. The system as claimed in claim 1, comprising a second pump having an inlet for receiving the gas stream from the first-mentioned pump and an outlet for exhausting the gas stream to the gas separating means.

5. The system as claimed in claim 1, comprising a second pump having an inlet for receiving the recovered purge gas and an outlet for exhausting the recovered purge gas to a conveying means.

6. The system as claimed in claim 5, comprising means for purifying the gas exhaust from the second pump.

7. The system as claimed in claim 1, comprising first gas recirculating means for recirculating the first gas from the separating means to the vacuum chamber.

8. The system as claimed in claim 7, wherein the recirculating means comprises means for purifying the received first gas.

9. The system as claimed in claim 8, wherein the recirculating means comprises means for pressurising the received first gas.

10. The system as claimed in claim 9, wherein the separating means comprises cryogenic separating means for separating cryogenically the first gas from the gas stream to recover both the first and second gases.

11. The system as claimed in claim 10, wherein the cryogenic separating means is arranged to condense the first gas without condensing the second gas.

12. The system as claimed in claim 1, wherein the first pump comprises a turbo-molecular pump.

13. The system as claimed in claim 1, wherein the first gas comprises a low thermal conductivity gas.

14. The system as claimed in claim 13 wherein said low thermal conductivity gas is selected from the group consisting of xenon and argon.

15. The system as claimed in claim 1, wherein the purge gas is lighter than the first gas.

16. The system as claimed in claim 15, wherein the purge gas comprises one of helium and nitrogen.

17. The apparatus of claim 1 wherein substantially all of the first gas is recirculated from the gas separating means to the vacuum chamber.

18. The apparatus of claim 1 wherein the first gas is recirculated from the separating means to the vacuum chamber in isolation from the second purge gas.

19. A vacuum pumping system, comprising first gas supply means for supplying a first gas to a vacuum chamber; a pump arranged to receive at least the first gas from the chamber; second gas supply means for supplying a second gas for pumping with the first gas; and gas separating means for receiving a gas stream output from the pump, recovering the first and second gases from the gas stream, outputting the recovered first gas to the first gas supply means for recirculation through at least the chamber and outputting the recovered second gas to the second gas supply means for recirculation through at least the pump.

20. An extreme ultra violet lithography apparatus comprising a vacuum pumping system as claimed in claim 1.

21. The apparatus of claim 19 wherein substantially all of the first gas is recirculated from the gas separating means to the vacuum chamber.

22. A method of vacuum pumping, comprising receiving at a pump at least a first gas from a vacuum chamber, and a second, purge gas for pumping with the first gas; exhausting from the pump a gas stream comprising the first and second gases; recovering the second gas from the stream and recirculating the recovered second gas through at least the pump.

23. The method as claimed in claim 22, wherein the second gas is recirculated through both the vacuum chamber and the pump.

24. The method as claimed in claim 22, wherein the pressure of the gas stream exhausted from the pump is increased prior to the recovery of the second gas therefrom.

25. The method as claimed in claim 22, wherein the pressurised gas stream is purified prior to the recovery of the second gas stream therefrom.

26. The method as claimed in claim 22, wherein the pressure of the recovered second gas is increased prior to its recirculation.

27. The method as claimed in claim 26, wherein the pressurised, recovered second gas is purified prior to its recirculation.

28. The method as claimed in claim 22, wherein the first gas is recovered from the gas stream and recirculated to the vacuum chamber.

29. The method as claimed in claim 28, wherein the recovered first gas is purified prior to its return to the vacuum chamber.

30. The method as claimed in claim 29, wherein the recovered first gas is pressurised prior to its return to the vacuum chamber.

31. The method as claimed in claim 22, wherein the first gas is cryogenically separated from the gas stream to recover the first and second gases.

32. The method as claimed in claim 31, wherein the first gas is condensed without condensing the second gas to separate the first and second gases.

33. The method as claimed in claim 22, wherein the first gas comprises a low thermal conductivity gas.

34. The method as claimed in claim 33 wherein said low thermal conductivity gas is selected from the group consisting of xenon and argon.

35. The method as claimed in claim 22, wherein the second gas is lighter than the first gas.

36. The method as claimed in claim 22, wherein the second gas comprises one of helium and nitrogen.

37. The method of claim 22 wherein substantially all of the first gas is recirculated from the gas separating means to the vacuum chamber.

38. The method of claim 22 wherein the first gas is recirculated from the separating means to the vacuum chamber in isolation from the second purge gas.

39. A vacuum pumping system comprising:

a vacuum pump having an inlet and an outlet;

a vacuum chamber connected to the vacuum pump inlet;

a process fluid inlet connected to the vacuum chamber;

a purge fluid inlet connected to the vacuum pumping system upstream of the vacuum pump;

a separator connected to the vacuum pump outlet, wherein the separator comprises a process fluid outlet and a purge fluid outlet;

a recirculating means for pressurizing the process fluid recovered before returning the process fluid to the vacuum chamber.

40. The vacuum pumping system of claim 39 further comprising a purifier connected to the purge fluid outlet of the separator.

41. The vacuum pumping system of claim 39 further comprising a backing pump connected to the purge fluid outlet of the separator.

42. The vacuum pumping system of claim 39 wherein the process gas is xenon.

43. The vacuum pumping system of claim 39 wherein the purge gas is helium.

44. The vacuum pumping system of claim 39 wherein the purge gas outlet of the separator is connected to the vacuum chamber.

45. The vacuum pumping system of claim 39 wherein the purge gas outlet is connected to the vacuum pump inlet.

* * * * *